US006390408B1

(12) United States Patent
Madrzak et al.

(10) Patent No.: US 6,390,408 B1
(45) Date of Patent: May 21, 2002

(54) DEVICE AND PROCESS FOR WINDING A MATERIAL WEB

(75) Inventors: Zygmunt Madrzak, Heidenheim; Ewald Wetschenbacher, Zoebingen, both of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/577,488

(22) Filed: May 25, 2000

(30) Foreign Application Priority Data

May 26, 1999 (DE) ..... 199 23 930

(51) Int. Cl.[7] ..... B65H 18/06; B65H 18/26
(52) U.S. Cl. ..... 242/541.6
(58) Field of Search ..... 242/541.5, 541.6, 242/542.3

(56) References Cited

U.S. PATENT DOCUMENTS

| | | | | |
|---|---|---|---|---|
| 4,524,919 A | | 6/1985 | Wehrmann | |
| 4,867,387 A | * | 9/1989 | Schonmeier | 242/541.6 |
| 5,690,298 A | | 11/1997 | Rück | 242/542.3 |
| 5,779,183 A | | 7/1998 | Aalto et al. | 242/547 |
| 5,895,007 A | | 4/1999 | Moller et al. | 242/527.2 |
| 5,967,449 A | * | 10/1999 | Thomas et al. | 242/541.6 |

FOREIGN PATENT DOCUMENTS

| | | |
|---|---|---|
| DE | 4213712 | 10/1993 |
| DE | 19745005 | 7/1998 |
| DE | 29811053 | 10/1998 |
| DE | 19908496 | 8/2000 |
| EP | 0087644 | 9/1983 |
| EP | 664267 | 7/1995 |
| EP | 0714373 | 6/1996 |
| EP | 826615 | 3/1998 |
| JP | 4-153153 | 5/1992 |
| WO | 95/34495 | 12/1995 |
| WO | 98/52858 | 11/1998 |

OTHER PUBLICATIONS

Abstract of International Publication No. WO 99/67460, published Dec. 29, 1999.
Patent Abstracts of Japan, M–1310, vol. 16, No. 440 (Sep. 14, 1992).
Patent Abstracts of Japan, M–1646, vol. 18, No. 404 (Jul. 28, 1994).

* cited by examiner

*Primary Examiner*—John M. Jillions
(74) *Attorney, Agent, or Firm*—Greenblum & Bernstein, P.L.C.

(57) ABSTRACT

Device and process for winding a material web onto a winding core to form a wound reel. The device includes a reeling drum positionable against a winding core or a wound roll to form a winding nip, a secondary transport device to displace the winding core/wound roll along a path of travel, and a pressure device and an air squeezing element. Secondary transport device carries air squeezing element and pressure device, and pressure device is arranged to press air squeezing element against wound reel prior to a reel change. A primary transport device moves a new, still-empty reel spool into an initial winding position, and a lift device is coupled to air squeezing element and pressure device and to secondary transport device. Lift device is arranged to move air squeezing element and pressure device to distance from a rotational axis of wound reel which corresponds to a current layer thickness. The process includes guiding the material web over the reeling drum, and forming a winding nip between reeling drum/wound reel, moving the squeezing device and the pressure device toward wound reel to a distance which corresponds to a current layer thickness, pressing squeezing device against wound reel, and moving wound reel, squeezing device, and pressure device away from reeling drum and along a path of travel to a reel spool changing position.

20 Claims, 3 Drawing Sheets

22
23
11
12
13
24
19
21
S
18
10
17
M
16
9
15
14
25
27
26
29
28
31

22
11
24
9
10
M
14
27

23
22
12
11
24
10
30
M
27

11a
22
10
12
S
11
18
13
9
16
M
15
25
14
29
28
26
31
27

DEVICE AND PROCESS FOR WINDING A MATERIAL WEB

CROSS-REFERENCE TO RELATED APPLICATIONS

The present application claims priority under 35 U.S.C. §119 of German Patent Application No. 199 23 930.4, filed on May 26, 1999, the disclosure of which is expressly incorporated by reference herein in its entirety.

BACKGROUND OF THE INVENTION

1. Field of the Invention

The invention relates to a device and process for winding a material web, e.g., a paper or cardboard web.

2. Discussion of Background Information

The present invention is similar in general to the device disclosed in published Patent Application JP 4-153153A, which discloses a device for winding a material web. In particular, a roll 101 is rotationally mounted in pivot levers as an air squeezing element. Pressing cylinders engage with the pivot levers so that roll 101 can be brought into contact with the wound reel. The winding core of the wound reel is in contact with a secondary transport device 31 and 12 upon which the pivot levers (carrying the air squeezing element 101) are mounted. Wound reel 1, which remains in contact with the reeling drum 64 (FIG. 7A) during the winding process, is moved away into a reel spool changing position along with the air squeezing element 101 (FIG. 7B). The disclosure of published Patent Application JP 4-153153A, is expressly incorporated by reference herein in its entirety, A similar winding device, in which the air squeezing element is preferably embodied as a brush, is disclosed in EP 0714373, the disclosure of which is expressly incorporated by reference herein in its entirety.

An air squeezing element serves the purpose that proper winding is possible when the wound reel is moved a distance from the reeling drum (in preparing for a reel spool change). This prevents an undesired admission of air between the paper layers. Furthermore, the air squeezing element holds the separated web tail firmly against the wound reel while it is still rotating and then braked. The pressing device belonging to the air squeezing element can be controlled in such a way that the air squeezing element rests against the wound reel with a defined contact force, even if the diameter of the reel is still increasing (as long as the winding process has not yet ended).

It is known that winding devices of the type described at the outset are required to be able to form wound reels with as large a diameter as possible (i.e., with the greatest possible layer thickness). In the known winding devices, the air squeezing element, with its pressure device, is arranged in the lower region of the winding device.

An additional demand on the winding devices is that it should be possible in special cases to remove a wound reel from the machine prematurely. In such a case, it is possible that only relatively little paper has been wound up to this point, such that the wound reel diameter (or the layer thickness) only has a fraction of the normally attainable value. In this case, the air squeezing element in the known winding devices cannot be brought into contact with the wound reel because of the relatively low lift of the pressure device.

SUMMARY OF THE INVENTION

Therefore, the present invention provides a device for winding a material web in which the air squeezing element can be brought into contact with the wound reel even when a reel spool change must be performed relatively shortly after the beginning of the winding process, i.e., even when the wound reel to be removed has an exceptionally small diameter.

The present invention relates to a winding device that includes a lift device coupled to a secondary transport device, which carries an air squeezing element and its pressure device, and which moves the air squeezing element and its pressure device to a distance from a rotational axis of a wound reel which corresponds to a current layer thickness, According to the instant invention, three independent possibilities for movement are provided for the air squeezing device:

1. An at least approximately radial movement (in relation to the rotational axis of the wound reel), and, preferably, in an approximately vertical direction, for moving the air squeezing element toward a surface of the wound reel, taking into account a current size of the layer thickness;
2. An adjusting movement which can be performed by the pressure device to determine the level of the contact force, during which the contact force is kept at least approximately constant, at first while the layer thickness is still increasing, and subsequently also even while the layer thickness remains constant;
3. A movement in an at least approximately horizontal direction in which the air squeezing element follows the movement of the wound reel into the reel spool change position.

The invention is preferably used in the known winding machine according to International Publication No. WO 98/52858, the disclosure of which is expressly incorporated by reference herein in its entirety. In particular, this document discloses a winding machine whose reeling drum is preferably displaceable in the horizontal direction in order to be able to precisely adjust the level of line load in the winding nip.

The present invention is directed to a device for winding a material web onto a winding core to form a wound reel. The device includes a reeling drum, over which an approaching material web is adapted to run, being positionable against one of the winding core and the wound roll to form a winding nip, and a secondary transport device adapted to displace the winding core, and the wound roll formed thereon, along a path of travel. A pressure device and an air squeezing element are provided, wherein the secondary transport device is adapted to carry the air squeezing element and the pressure device, and wherein the pressure device is arranged to press the air squeezing element against the wound reel prior to a reel change. The air squeezing element is coupled to the secondary transport device to move along the path of travel, with the winding core and the wound reel formed thereon, in a direction away from the reeling drum and into a reel spool changing position. A primary transport device is adapted to move a new, still-empty reel spool into an initial winding position, and a lift device is coupled to the air squeezing element and the pressure device and to the secondary transport device. The lift device is arranged to move the air squeezing element and the pressure device to a distance from a rotational axis of the wound reel which corresponds to a current layer thickness.

In accordance with a feature of the invention, the winding core can include a reel spool, the material web can include one of a paper and a cardboard web, and the path of travel can be a substantially horizontal path of travel.

According to another feature of the present inventions the secondary transport device can also include a guide arranged to guide the lift device in an essentially vertical direction.

Further, the secondary transport device can also include a secondary transport carriage arranged in a region of each material web edge, and each secondary transport carriage includes a guide path arranged to guide the lift device and the air squeezing element. The lift device can include a cross member which extends between the secondary transport carriages. One of the secondary transport carriages can be arranged on a guide side and one of the secondary transport carriages is arranged on a drive side. Still further, the lift device can include a lift drive arranged to vertically displace the lift device and the cross member. Moreover, the pressure device can include a pneumatic hose supported on the cross member and can be adapted to carry the air squeezing element.

In accordance with still another feature of the invention, the air squeezing element can include a roll arrangement. Further, the roll arrangement can include one of a continuous roll body and a plurality of roll body segments.

According to a further feature of the instant invention, the air squeezing element can include a brush body.

According to another feature of the present invention, the air squeezing element can include a base with a low-friction coating.

In accordance with a still further feature of the present invention, at least two pivot levers can be coupled to the pressure device and can be mounted on the lift device. The at least two pivot levers may be pivotable in a lift direction. The The present invention is also directed to a process for winding a material web onto a winding core to form a wound reel in an apparatus that includes a reeling drum, a primary transport device, a secondary transport device, an air squeezing element, a pressure device, and a lift device. The process includes guiding the material web over the reeling drum, and forming a winding nip between the reeling drum and the wound reel, moving, via the lifting device, the squeezing device and the pressure device toward the wound reel to a distance from a rotational axis of the wound reel which corresponds to a current layer thickness, pressing, via the pressure device, the squeezing device against the wound reel, and moving the wound reel, the squeezing device, and the pressure device away from the reeling drum and along a path of travel to a reel spool changing position.

According to a feature of the instant invention, the process further includes positioning, via the primary transport device, a new still empty winding core against the reeling drum after the wound reel has been moved away from the reeling drum, pressing the new still empty winding core against the reeling drum, cutting the material web, wherein a new web tail is formed, and winding the new web tail on the new still empty winding core to form another wound reel.

In accordance with another feature of the invention, the process further includes braking the wound reel, removing the air squeezing device from the wound reel, and removing the wound reel from the apparatus.

According to still another feature of the present invention, the moving of the squeezing device and the pressure device via the lift device may occur before the wound reel is fully wound.

Other exemplary embodiments and advantages of the present invention may be ascertained by reviewing the present disclosure and the accompanying drawing.

BRIEF DESCRIPTION OF THE DRAWINGS

The present invention is flier described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figures 1, 2, 3, 4:
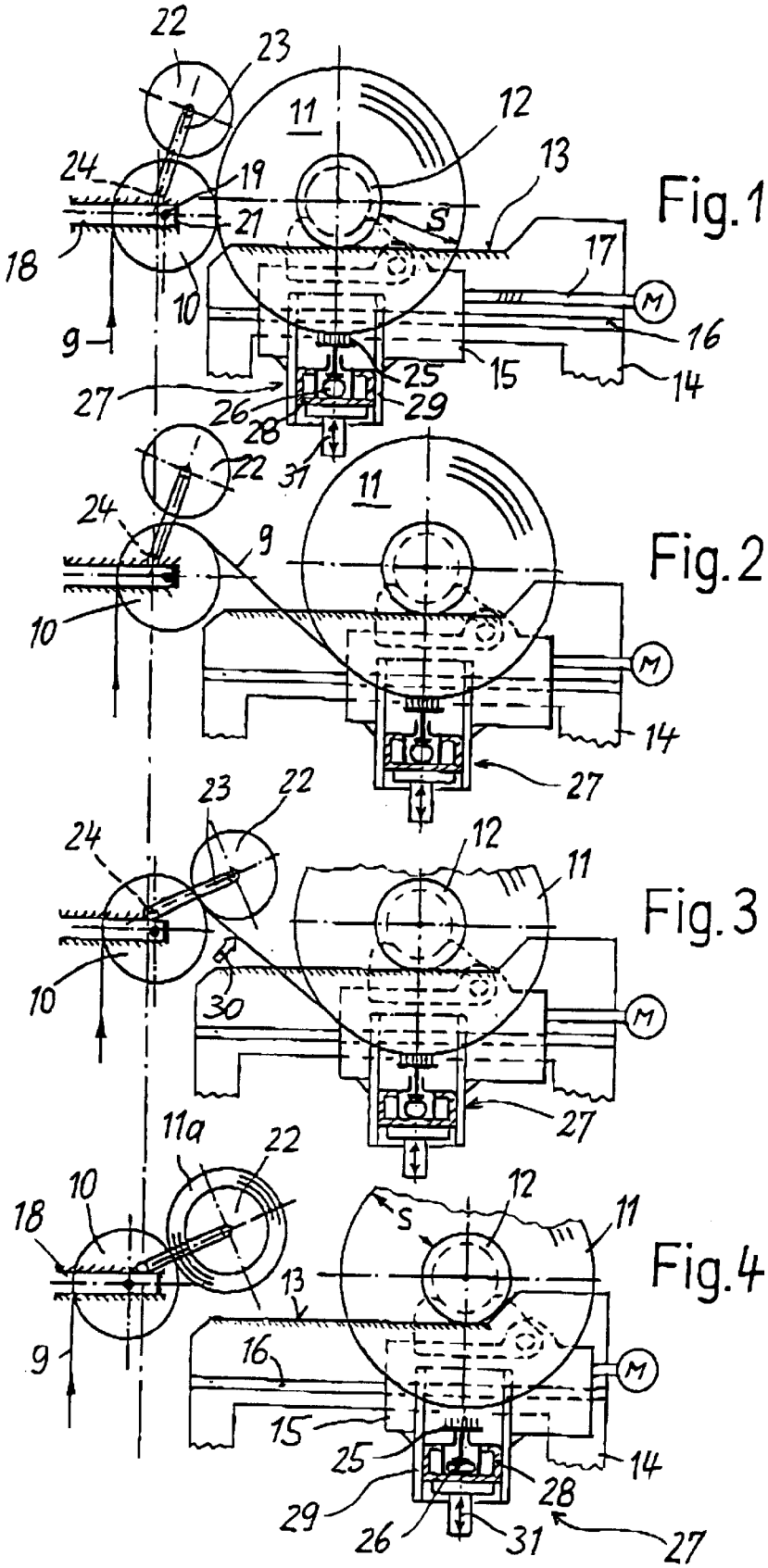
FIGS. 1–6 schematically illustrate a side view of a winding machine in various operating positions during a winding operation.

The particulars shown herein are by way of example and for purposes of illustrative discussion of the embodiments of the present invention only and are presented in the cause of providing what is believed to be the most usefull and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

A paper web 9 to be wound runs from below onto a reeling drum 10 which is also referred to as a "pressing drum." The paper web wraps around the upper region of reeling drum 10 and finally runs through a winding nip formed by reeling drum 10 and a wound reel 11. Wound reel 11 is formed on a winding core, e.g., a reel spool 12, in the shape of a roll, during a winding process. Reel spool 12 is supported on each of its ends by a rail 13 which is part of a machine frame 14.

On each of the machine frames 14 is a secondary transport carriage 15, which can be displaced along a horizontal guide path 16, e.g., with the aid of a threaded spindle 17 or a similar drive.

The position of reel spool 12 is constantly (e.g., continually or in small steps) adapted to the increasing diameter of wound reel 11 (i.e., increasing layer thickness S) by displacement of wound reel 11 on rails 13.

Reeling drum 10 rotatably rests in bearings 19 which are only symbolically indicated as a point and which are displaceable along a preferably horizontal guide 18. For this purpose, a preferably hydraulic displacement device (not shown) is provided which presses reeling drum 10 against wound reel 11 with a desired adjustable line load. Notwithstanding the drawing, the guide can be so long that the above-mentioned displacement of wound reel 11 on rails 13 is not necessary during a normal winding process. However, in either case, the following is true:

In order to prepare a reel spool change in the case of a continually approaching material web 9, a new, still-empty reel spool 22 is placed in a primary transport device 23, which essentially includes two pivot levers, each of which is mounted in a stationary bearing 24.

While not shown, the device includes a drive for reeling drum 10, a first central drive for new reel spool 22 (which is effective as long as new reel spool 22 is located in primary transport device 23), and a second central drive which engages when primary transport device 23 has released reel spool 11 (i.e., after the beginning of the new winding process) onto horizontal guide path 13.

Another feature of the winding machine according to the invention is an air squeezing element 25 carried by secondary transport device 15. According to FIG. 1, air squeezing element 25 is pressed against wound reel 11, e.g., from below, some time before the end of a winding process, i.e., shortly before the beginning of a reel spool changing process, e.g., before the opening of the winding nip.

According to FIG. 2, in order to perform a reel spool change, an almost fill wound reel 11 on reel spool 12 is removed from reeling drum 10 along with air squeezing element 25 on rails 13 and brought into a reel spool change position. In this manner, air squeezing element 25 serves to prevent air from being trapped in between the layers of paper. In the operating position according to FIG. 2, reeling drum 10 is located at an end stop 21 of guide 18.

After wound reel 11 has reached the reel spool change position (see FIG. 2), new reel spool 22 is moved downwardly with the aid of primary transport device 23, e.g., as illustrated in FIG. 3, into a position in which a certain distance still exists between new reel spool 22 and guide rails 13. This is the so-called "winding start position." At first, paper web 9 is still running to wound reel 11, at which point it slightly wraps around new reel spool 22 and new reel spool 22 has pushed reeling drum 10 back away from stop 21. In this manner, a line load acting in the new winding nip (i.e., between reeling drum 10 and new reel spool 22) can be precisely adjusted even before beginning of the new winding process. The new winding process is initiated in a known manner in that a separating element (shown symbolically by an arrow 30) separates running paper web 9 in a crosswise manner. A new web tail is formed that rests against new reel spool 22, such that a new wound reel 11*a* is formed (see FIG. 4). Now, full wound reel 11 is braked, with air squeezing element remaining in contact with wound reel 11, such that the end of the paper web is held firmly against wound reel 11.

According to FIG. 4, at the end of the reel spool changing process, the finished wound reel 11 is located in an end position that is even more distant from reeling drum. When wound reel 11 is braked to a standstill, air squeezing element 25 is removed from wound roll 11, e.g., as shown in FIG. 4. Wound reel 11 can now be removed (e.g., with the aid of a crane).

Thereafter, secondary transport device 15 travels along with air squeezing element 25 back into the vicinity of reeling drum 10, where it receives new reel spool 22 with new wound reel 11*a*. Once the latter has reached the desired layer thickness, a new reel spool changing process begins according to FIG. 1.

Figure 7:
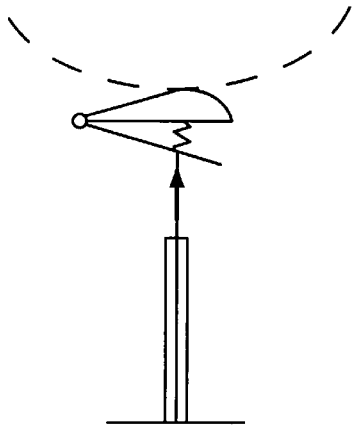
FIGS. 7, 8, 9*a*, 9*b*, and 10 illustrate alternative embodiments for the air squeezing element and lift device.
Figure 8:
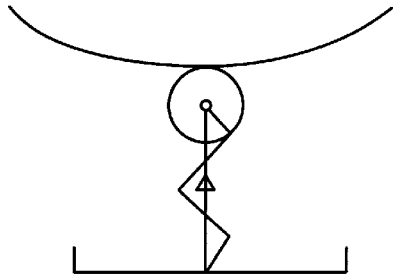
Figure 9A:
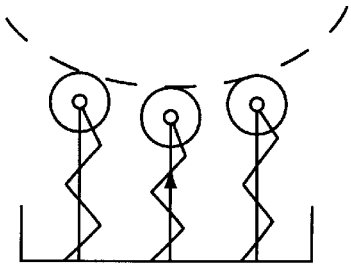
Figure 9B:
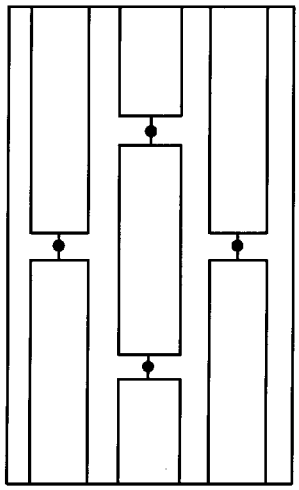
Figure 10:
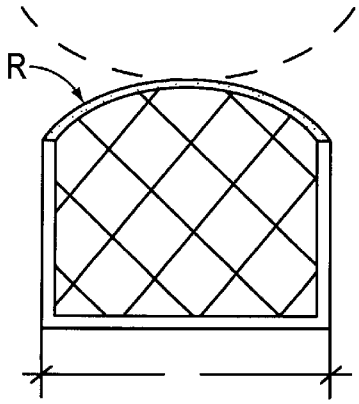

Details of the present invention relating to air squeezing element 25 will now be described. In an exemplary embodiment of the invention, a brush can be arranged to extend crosswise across entire paper web 9 as air squeezing element 25. In the exemplary embodiment shown, a pneumatic hose 26, which also runs crosswise through the winding machine, can be provided to carry air squeezing element 25 and to act as a pressure device 26. When pneumatic hose 26 is provided with air, it presses air squeezing element 25 against the reel 11 (see FIGS. 1–3). When the pressure is released, air squeezing element 25 moves away from wound reel 11 (see FIG. 4). Notwithstanding pressure device 26, the following can be provided: Air squeezing element 25 can rest on a cross member, each of whose ends is attached to a pivot lever (FIG. 7), so that air squeezing element 25 (as in the prior art) can be pivoted up and down. Air squeezing element 25 can also be structured differently, e.g., instead of a brush, use of a one-part (FIG. 8) or multi-part roll (FIGS. 9*a* and 9*b*), or a base with a low friction coating R (FIG. 10) is possible. Moreover, as various constructions according to German Patent Application No. 199 08 496 can also be utilized, the disclosure of this German document is expressly incorporated by reference herein in its entirety.

According to the invention, no matter what constructions are used for air squeezing element 25 and pressure device 26, secondary transport 15 is provided in a lift device (designated as a whole in the drawings as 27) that carries air squeezing element 25 and its pressure device 26. In the exemplary embodiment shown, a cross member 28 can be arranged to extend crosswise through the winding machine from one secondary transport carriage 15 to another is part of lift device 27. Each secondary transport carriage 15 has a preferably vertical guide 29 along which cross member 28 is displaceable along with air squeezing element 25. A drive 31, which is only symbolically shown, serves to displace cross member 28 along guide path 29.

Figure 5:
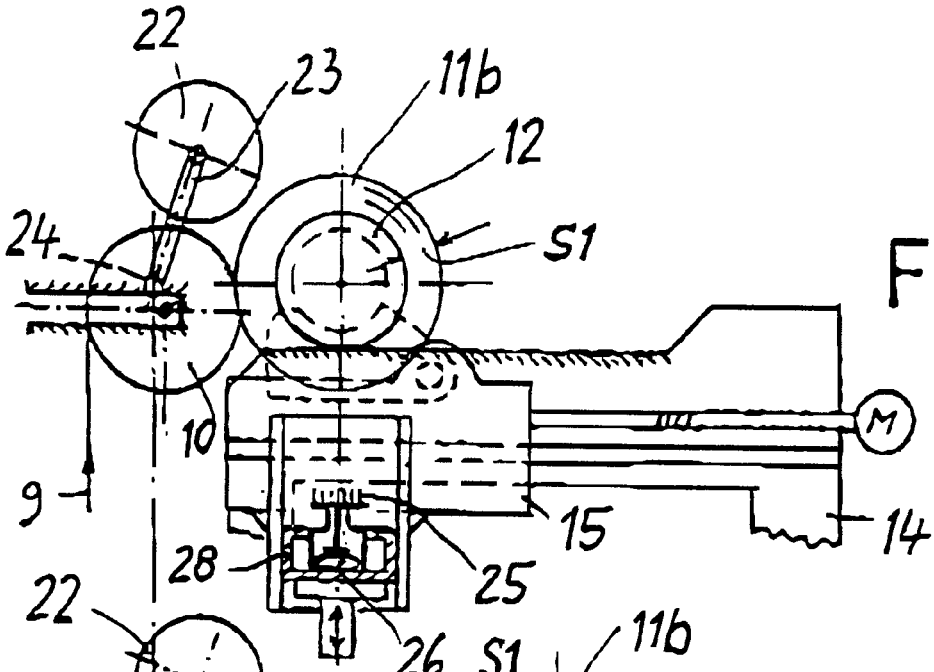
Figure 6:
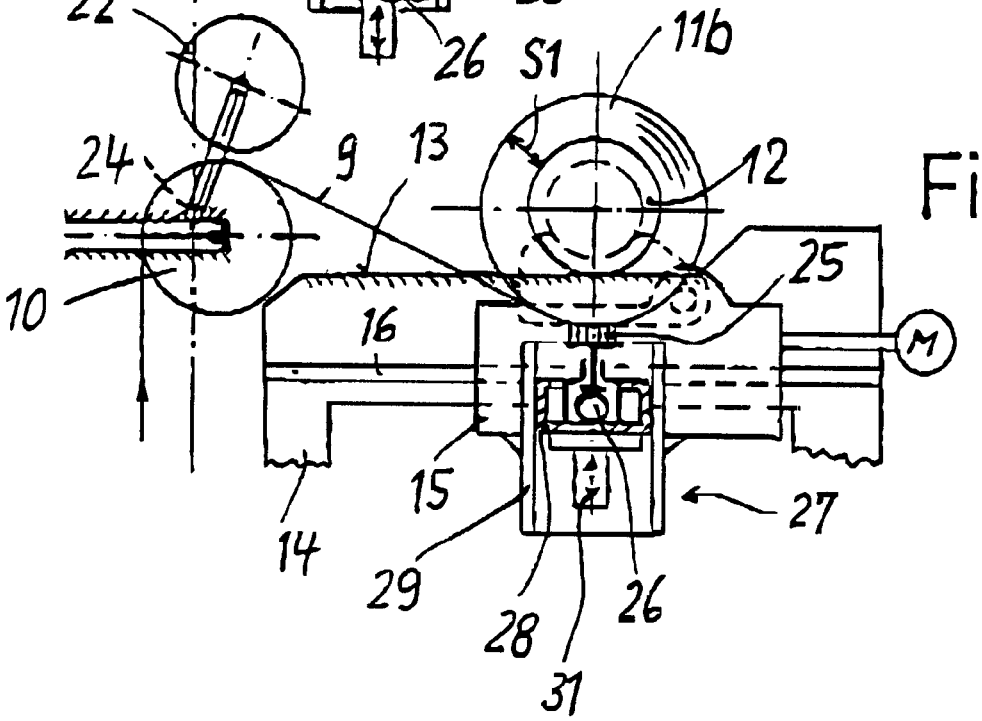

Lift device 27 serves the purpose of moving air squeezing element 25 and its pressure device 26 to a distance from the rotational axis of wound reel 11 that corresponds to a momentary layer thickness of wound reel 11, (see, e.g., FIGS. 5 and 6). According to FIG. 5, a reel spool change is being prepared even though wound reel 11*b* has a low layer thickness S1 (as compared to FIG. 1). According to FIG. 5, pneumatic hose 26 is still unpressurized and cross member 28 is still in its lower position.

Therefore, in order to perform the reel spool change, cross member 28 with air squeezing element 25 is moved upwardly in accordance with the present layer thickness S1 of wound reel 11*b*. This thickness can be detected, e.g., with at least one optical sensor. Then air squeezing element 25 is placed against wound reel 11*b* through the application of pressure in pneumatic hose 26. Now, secondary transport device 15 can move wound roll 11*b* into the reel spool changing position with air squeezing element 25 resting thereon (see FIG. 6), It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A device for winding a material web onto a winding core to form a wound reel, the device comprising:

a reeling drum, over which an approaching material web is adapted to run, being positionable against one of the winding core and the wound roll to form a winding nip;

a secondary transport device adapted to displace the winding core, and the wound roll formed thereon, along a path of travel;

a pressure device;

an air squeezing element, wherein said secondary transport device is adapted to carry said air squeezing element and said pressure device, and wherein said pressure device is arranged to press said air squeezing element against the wound reel prior to a reel change;

said air squeezing element being coupled to said secondary transport device to is move along the path of travel, with the winding core and the wound reel formed thereon, in a direction away from said reeling drum and into a reel spool changing position, a primary transport device adapted to move a new, still-empty reel spool into an initial winding position, and a lift device coupled to said air squeezing element and said pressure device and to said secondary transport device, said lift device being arranged to move said air squeezing element and said pressure device to a distance from a rotational axis of the wound reel which corresponds to a current layer thickness.

2. The device in accordance with claim 1, wherein said winding core comprises a reel spool, wherein said material web comprises one of a paper and a cardboard web, and wherein said path of travel is a substantially horizontal path of travel.

3. The device in accordance with claim 1, wherein said secondary transport device further comprises a guide arranged to guide said lift device in an essentially vertical direction.

4. The device in accordance with claim 1, wherein said secondary transport device further comprises a secondary transport carriage arranged in a region of each material web edge, and wherein each said secondary transport carriage includes a guide path arranged to guide said lift device and said the air squeezing element; and said lift device comprising a cross member which extends between said secondary transport carriages.

5. The device in accordance with claim 4, wherein one of said secondary transport carriages is arranged on a guide side and one of said secondary transport carriages is arranged on a drive side.

6. The device in accordance with claim 4, further comprising a lift drive arranged to vertically displace said lift device and said cross member.

7. The device in accordance with claim 4, wherein said pressure device comprises a pneumatic hose is supported on said cross member and is adapted to carry said air squeezing element.

8. The device in accordance with claim 1, wherein said air squeezing element comprises a roll arrangement.

9. The device in accordance with claim 8, wherein said roll arrangement comprises one of a continuous roll body and a plurality of roll body segments.

10. The device in accordance with claim 1, wherein said air squeezing element comprises a brush body.

11. The device in accordance with claim 1, wherein said air squeezing element comprises a base with a low-friction coating.

12. The device in accordance with claim 1, further comprising at least two pivot levers coupled to said pressure device and mounted on said lift device, wherein said at least two pivot levers are pivotable in a lift direction.

13. A process for winding a material web onto a winding core to form a wound reel in an apparatus that includes a reeling drum, a secondary transport device, an air squeezing element, a pressure device, and a lift device, the process comprising:

guiding the material web over the reeling drum, and forming a winding nip between the reeling drum and the wound reel;

moving, via the lifting device, the squeezing device and the pressure device toward the wound reel to a distance from a rotational axis of the wound reel which corresponds to a current layer thickness;

pressing, via the pressure device, the squeezing device against the wound reel;

moving, via the secondary transport device, the wound reel, the squeezing device, and the pressure device away from the reeling drum and along a path of travel to a reel spool changing position.

14. The process in accordance with claim 13, wherein the apparatus further includes a primary transport device and the process further comprises:

positioning, via the primary transport device, a new still empty winding core against the reeling drum after the wound reel has been moved away from the reeling drum;

pressing the new still empty winding core against the reeling drum;

cutting the material web, wherein a new web tail is formed; and winding the new web tail on the new still empty winding core to form another wound reel.

15. The process in accordance with claim 13, further comprising:

braking the wound reel;

removing the air squeezing device from the wound reel; and removing the wound reel from the apparatus.

16. The process in accordance with claim 13, wherein the air squeezing device comprises a roll arrangement.

17. The process in accordance with claim 16, wherein the roll arrangement comprises one of a continuous roll body and a plurality of roll body segments.

18. The process in accordance with claim 13, wherein the air squeezing element comprises a brush body.

19. The process in accordance with claim 13, wherein the air squeezing element comprises a base with a low-friction coating.

20. The process in accordance with claim 13, wherein the moving of the squeezing device and the pressure device via the lift device occurs before the wound reel is fully wound.

* * * * *